US006641251B1

(12) United States Patent
Rodriguez

(10) Patent No.: US 6,641,251 B1
(45) Date of Patent: Nov. 4, 2003

(54) PRINTING SYSTEM FOR PRINTING IN SCAN AND PRINT MEDIA FEED DIRECTIONS AND METHOD OF PERFORMING A PRINTING OPERATION

(75) Inventor: Julio A. Rodriguez, San Juan, PR (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 10/195,940

(22) Filed: Jul. 15, 2002

(51) Int. Cl.[7] ..... B41J 2/15
(52) U.S. Cl. ..... 347/40; 347/43; 347/41; 347/15
(58) Field of Search ..... 347/40, 12, 15, 347/43, 41

(56) References Cited

U.S. PATENT DOCUMENTS

| | | | | |
|---|---|---|---|---|
| 5,016,023 A | | 5/1991 | Chan et al. | |
| 5,357,268 A | | 10/1994 | Kishida et al. | |
| 5,398,053 A | | 3/1995 | Hirosawa et al. | |
| 5,719,602 A | | 2/1998 | Hackleman et al. | |
| 5,742,305 A | | 4/1998 | Hackleman | |
| 5,924,809 A | | 7/1999 | Wotton et al. | |
| 5,984,450 A | | 11/1999 | Becker | |
| 6,082,002 A | | 7/2000 | Belon et al. | |
| 6,089,693 A | * | 7/2000 | Drake et al. | 347/19 |
| 6,460,969 B1 | * | 10/2002 | Pinkernell | 347/43 |

* cited by examiner

*Primary Examiner*—Lamson Nguyen

(57) ABSTRACT

A printing system for depositing ink onto print media. The printing system includes first and second printhead arrays. The first printhead array deposits ink onto the print media in a scan direction. The second printhead array deposits ink onto the print media in a print media feed direction.

23 Claims, 10 Drawing Sheets

PRINTING SYSTEM FOR PRINTING IN SCAN AND PRINT MEDIA FEED DIRECTIONS AND METHOD OF PERFORMING A PRINTING OPERATION

TECHNICAL FIELD

This invention relates to depositing marking fluid onto print media in both a scan direction and a print media feed direction to form images and text on different areas of the print media.

BACKGROUND OF THE INVENTION

Throughout the business world, inkjet printing systems are extensively used for image reproduction. Inkjet printing systems frequently make use of one or more inkjet printheads mounted within a carriage that is moved back and forth across print media, such as paper. For example, the carriage may include a single printhead that is capable of printing a single color (i.e., black), a single printhead capable of printing multiple colors (i.e., black, cyan, magenta and yellow), a first printhead capable of printing one color (i.e., black) and a second printhead capable of printing multiple colors (i.e., cyan, magenta and yellow), or four printheads, each capable of printing a single different color.

Typically, the carriage is movable in a "scan" direction back and forth across the width of the print media. As the carriage is moved in the scan direction, back and forth across the print media, a control system activates the printhead(s) to deposit or eject ink droplets onto the print media to form images and text. Between scans, the print media is advanced along a print media "feed" direction, which is typically parallel to the length of the print media. During print media movement in the feed direction, the printhead(s) do not deposit ink droplets on to the print media. Such systems may be used in a wide variety of applications, including computer printers, plotters, copiers and facsimile machines.

Ink is provided to the printhead(s) mounted to the carriage by one or more supplies of ink that are either carried by the carriage or mounted to the printing system such that the supplies of ink do not move with the carriage. For the case where the ink supplies are not carried with the carriage, the ink supplies can be in fluid communication with the printhead(s) to replenish the printhead(s) or the printhead(s) can be intermittently connected with the ink supplies by positioning the printhead(s) proximate to a filling station to which the ink supplies are connected whereupon the printhead(s) are replenished with ink from the refilling station.

For the case where the ink supplies are carried with the carriage, one ink supply may be integral with each printhead whereupon the entire printhead and ink supply is replaced when ink is exhausted. Alternatively, the ink supplies can be carried with the carriage and can be separately replaceable from the printhead(s).

For convenience, the concepts of the invention are discussed in the context of thermal inkjet printheads. A thermal inkjet printhead die includes an array of firing chambers having orifices (also called nozzles) which face the print media. The ink is applied to individually addressable ink energizing elements (such as firing resistors) within the firing chambers. Energy provided by the firing resistors heats the ink within the firing chambers causing the ink to bubble. This in turn causes the ink to be expelled out of the orifice of the firing chamber toward the print media. As the ink is expelled, the bubble collapses and more ink is drawn into the firing chambers, allowing for repetition of the ink expulsion process.

Typically to increase print media throughput (i.e. to increase the speed of printing per page of print media), it is to necessary to increase the firing rate of the firing chambers, maximize the density of the firing chambers (i.e. firing resistors) and/or increase the number of firing chambers. With regards to increasing the firing rate of the firing chambers, the ability to do this is somewhat limited by ink composition and the heat generated by the process of repeatedly firing the firing chambers. Hence, the ability to increase the print media throughput of a printing system by increasing the firing rate of the firing chambers of the printhead(s) is somewhat limited given the already high firing frequency of printhead firing chambers.

Maximizing the density of the firing chambers and/or increasing the number of firing chambers to increase print media throughput, typically necessitates an increase in the size of the printhead die and/or a miniaturization of printhead die components. With regards to miniaturization of the printhead die components, once a certain degree of miniaturization has been reached, conventional manufacturing by assembling separately produced components becomes more difficult and costly. In addition, the substrate that supports firing resistors, the barrier that isolates individual resistors, and the orifice plate that provides a nozzle above each resistor are all subject to small dimensional variations that can accumulate to limit miniaturization. Further, the assembly of such components for conventional printheads requires precision that limits manufacturing efficiency. Hence, increasing the print media throughput of a printing system by miniaturization of printhead die components of the printhead(s) is somewhat limited by manufacturing practicalities and costs.

With regards to increasing the size of the printhead die to increase print media throughput, printheads employing Page Wide Arrays (PWA's) have already been developed. In a PWA printhead, the firing chambers extend across the full width of the print media thereby eliminating the need of the carriage supporting the PWA printhead to be moved back and forth across the print media. In other words, to perform a full page printing operation using a PWA printhead, the print media need only be stepped past the PWA printhead in the print media feed direction (i.e., parallel to the length of the print media) while the PWA printhead remains stationary. This elimination of the movement of the PWA printhead and the depositing of ink droplets in the scan direction results in an increase in print media throughput. Although the use of a PWA printhead increases print media throughput, there are some disadvantages to the use of PWA printheads. Namely the cost and complexity associated with manufacturing PWA printhead die components and the subsequent cost to consumers of replacing a PWA printhead at the end of printhead life.

As such, there is a need for printing systems with increased print media throughput. In particular, there is a need for an increased print media throughput printing system that makes use of conventional, non PWA printheads.

SUMMARY OF THE INVENTION

One embodiment of the present invention is a printing system for depositing marking fluid onto print media. The printing system includes first and second marking engines. The first marking engine deposits a first marking fluid onto the print media in a scan direction. The second marking engine deposits a second marking fluid onto the print media in a print media feed direction.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principles of the invention. Other embodiments of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
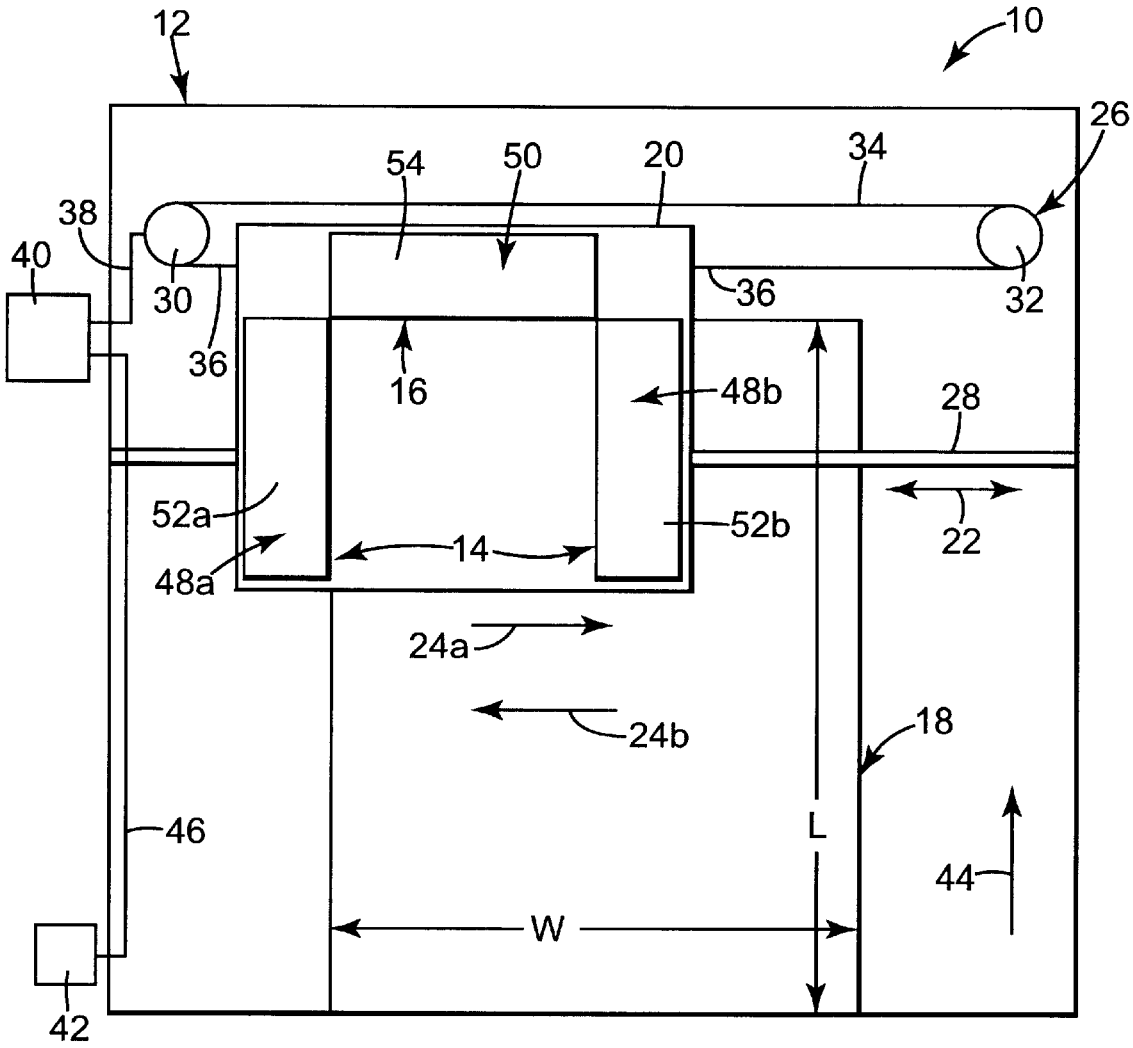
FIG. 1 is a schematic drawing of a printing system having three printhead arrays printing in scan and print media feed directions in accordance with one embodiment of the present invention.

FIG. 1 depicts a schematic representation of a printing system, such as a thermal inkjet printing system 10 which includes a printing mechanism 12 in accordance with one embodiment of the present invention. The printing mechanism 12 includes a first marking engine 14 and a second marking engine 16. The first and second marking engines 14, 16 deposit a marking fluid, such as ink, onto print media 18, such as paper. The print media 18 has a width dimension "W" and a length dimension "L" which is greater than the width dimension "W" (see FIG. 1).

As seen best in FIG. 1, the first and second marking engines 14, 16 are mounted on a movable carriage 20. The carriage 20 (and thereby first and second marking engines 14, 16) is linearly movable in a "scan" direction 22 (see double headed arrow), back and forth across the width dimension "W" of the print media 18. The scan direction 22 is particularly defined by a forward scan track 24*a* (see single headed arrow) and a back scan track 24*b* (see single headed arrow).

The carriage 20 is movable in the scan direction 22, in a known manner, by way of a scan drive mechanism 26 coupled thereto. The scan drive mechanism 26 includes a linear guide rod 28 mounted to the printing system 10. The carriage 20 is guided by the linear guide rod 28 so as to move linearly back and forth in the scan direction 22. The scan drive mechanism 26 is further defined by a drive motor, such as stepper motor 30 which is spaced from a pulley 32. A drive element, such as a drive belt 34 extends about the stepper motor 30 and the pulley 32. Free ends 36 of the drive belt 34 are coupled to the carriage 20. One similar scan drive mechanism is disclosed in U.S. Pat. No. 5,924,809 to Wotton et al. assigned to the same assignee as the instant application and incorporated herein by reference thereto.

Operation of the stepper motor 30 causes movement of the drive belt 34, and thereby linear movement of the carriage 20 in the scan direction 22 along the linear guide rod 28 forward (see forward scan track 24a) and back (see back scan track 24*b*) across the width "W" of the print media 18. The stepper motor 30 of the scan drive mechanism 26 is linked by signal transmission line 38 to printing system control electronics 40. The control electronics 40 control movement of the carriage 20 via the stepper motor 30 in accordance with the print job to be performed on the print media 18 by the first and second marking engines 14, 16.

As seen best in FIG. 1, the printing system 10 further includes a print media feed drive mechanism 42 for linearly moving the print media 18, in a known manner, in a "print media feed" direction 44 (see single headed arrow) relative to the first and second marking engines 14, 16 of the carriage 20. One similar print media feed drive mechanism is disclosed in U.S. Pat. No. 6,082,002 to Belon et al. assigned to the same assignee as the instant application and incorporated herein by reference thereto.

The print media feed direction 44 is substantially perpendicular to the scan direction 22 of the first and second marking engines 14, 16, and substantially parallel to the length dimension "L" of the print media 18. The print media feed drive mechanism 42 is coupled to the control electronics 40 via a signal transmission line 46. The control electronics 40 control movement of the print media 18 in the print media feed direction 44, via the print media feed drive mechanism 42, in accordance with the print job to be performed on the print media 18 by the first and second marking engines 14, 16.

The first marking engine 14 includes a first fluid ejection array, otherwise known as a first scan printhead array 48*a* and a second fluid ejection array, otherwise known as a second scan printhead array 48*b* which is spaced from the first scan printhead array 48*a* along the scan direction 22. In one preferred embodiment, the first and second scan printhead arrays 48*a*, 48*b* are identical, so only the first scan printhead array 48*a* will be described with particularity. Moreover, like parts are labeled with like numerals with the first scan printhead array 48*a* being designated by "a" and the second scan printhead array 48*b* being designated by "b".

Each of the first and second scan printhead arrays 48*a*, 48*b* deposit marking fluid, such as ink, onto the print media 18 in only the scan direction 22. In particular, as will be made clear below, the first scan printhead array 48*a* deposits the marking fluid onto the print media 18 only during the forward scan track 24*a*, while the second scan printhead array 48*b* deposits marking fluid onto the print media 18 only during the back scan track 24*b*. Moreover, as will be made clear below, only one of the first and second scan printhead arrays 48*a*, 48*b* deposits marking fluid onto the print media 18 at a time. Additionally, as will be made clear below, the first and second scan printhead arrays 48*a*, 48*b* deposit marking fluid onto different portions of the print media 18.

The second marking engine 16 is defined by a fluid ejection array, otherwise known as a print media feed printhead array 50. As seen in FIG. 1, on the carriage 20, the print media feed printhead array 50 is interposed between and offset from (in the print media feed direction 44) the first and second scan printhead arrays 48*a*, 48*b*. The print media feed printhead array 50 deposits marking fluid, such as ink, onto the print media 18 in only the print media feed direction 44. In other words, only when the print media 18 is advanced by the print media feed drive mechanism 42. As will be made clear below, the print media feed printhead array 50 deposits marking fluid onto different portions of the print media 18 than the first and second scan printhead arrays 48*a*, 48*b*.

As stated previously, the first and second scan printhead arrays 48*a*, 48*b* are identical. In one preferred embodiment, the print media feed printhead array 50 is identical to the first and second scan printhead arrays 48*a*, 48*b*, except that the print media feed printhead array 50 is turned 90° relative to the first and second scan printhead arrays 48*a*, 48*b* so as to allow the print media feed printhead array 50 to deposit marking fluid onto the print media 18 when the print media 18 is advanced in the print media feed direction 44 via the print media feed drive mechanism 42.

Figure 2:
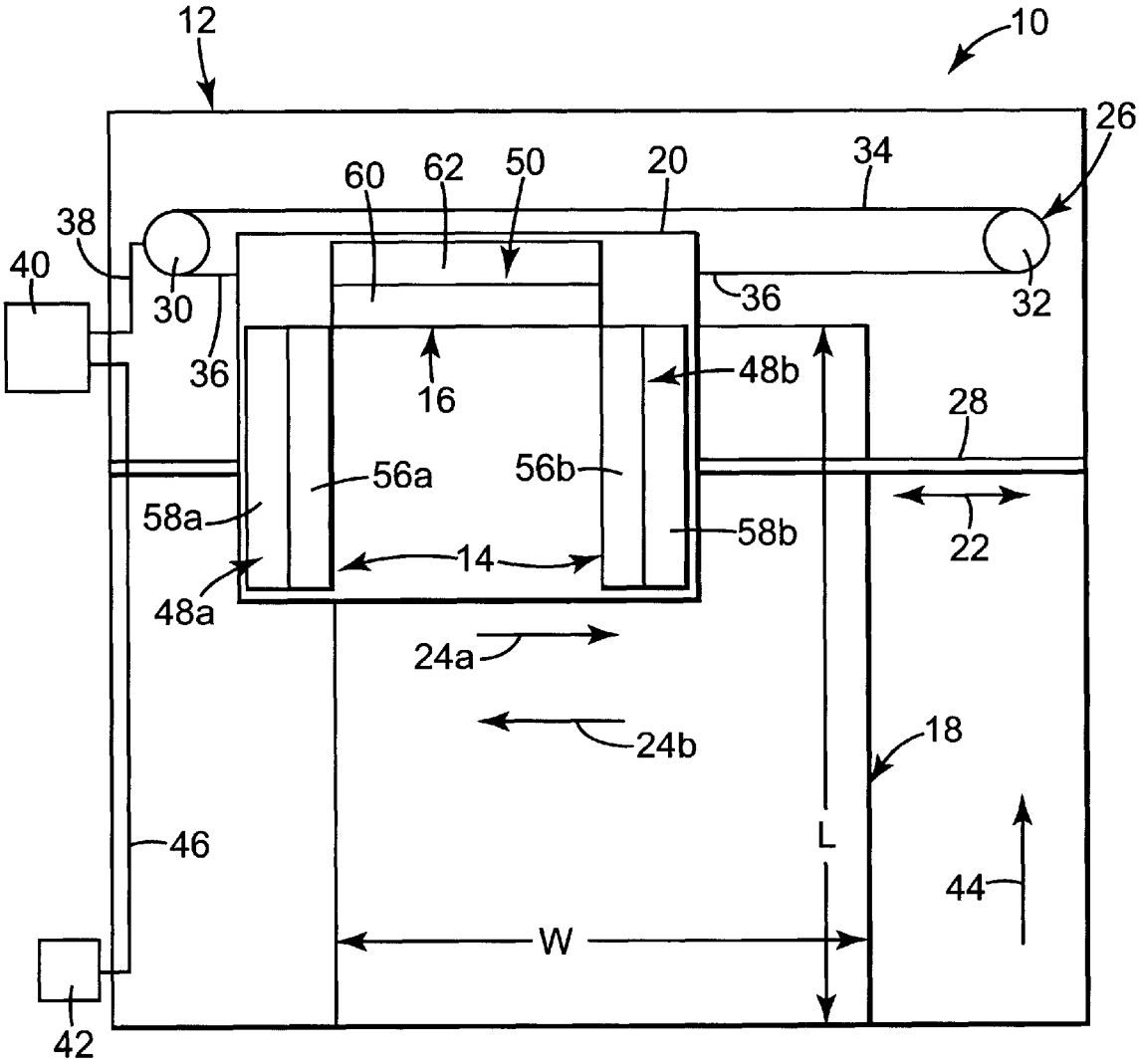
FIG. 2 is a schematic drawing similar to FIG. 1 illustrating an alternative printing system in which each of the printhead arrays includes two printheads.
Figure 3:
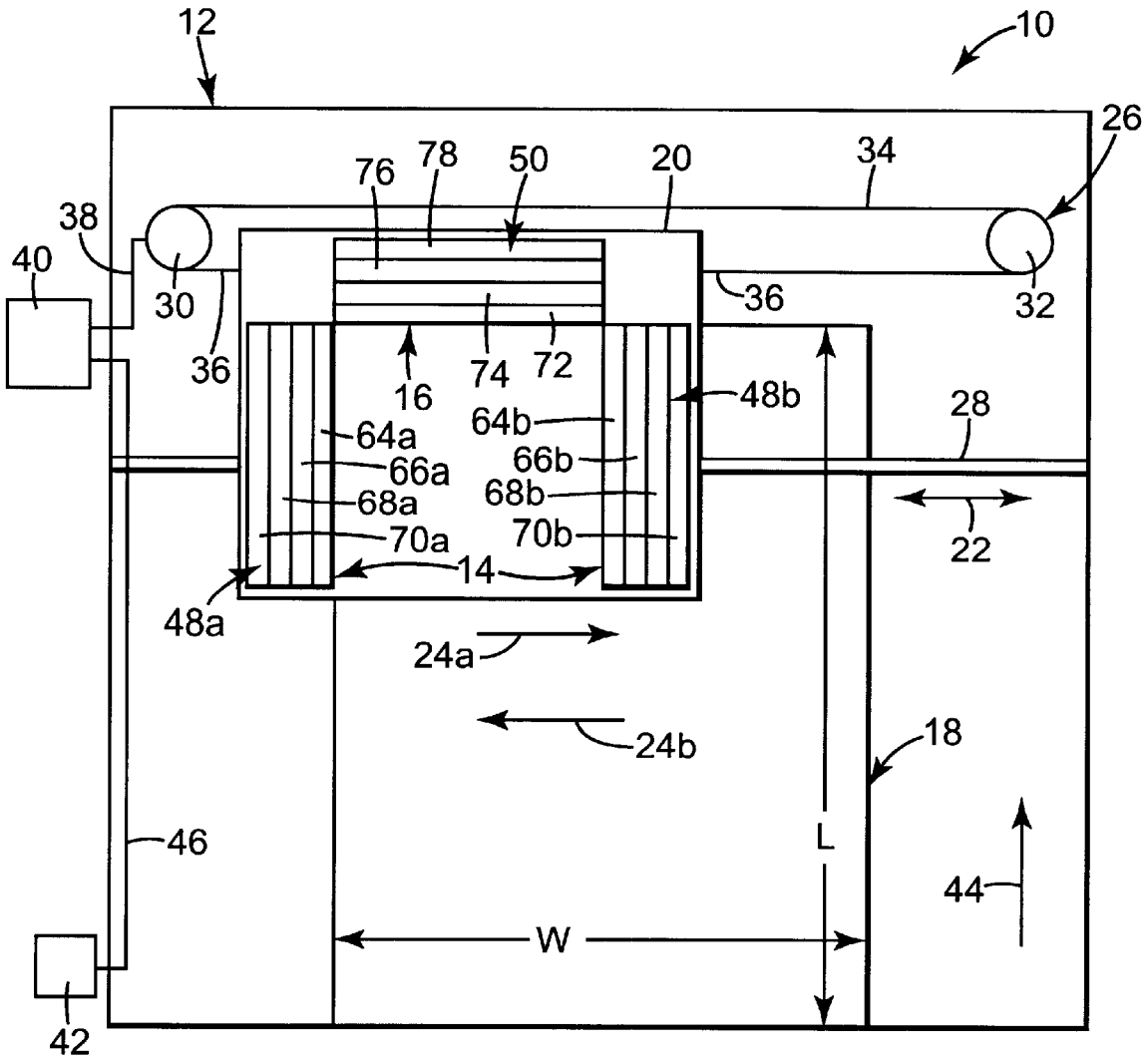
FIG. 3 is a schematic drawing similar to FIG. 1 illustrating another alternative printing system in which each of the printhead arrays includes four printheads.

In one preferred embodiment, each of the first and second scan printhead arrays 48*a*, 48*b* is defined by a single replaceable printhead 52*a*, 52*b* for printing multiple colors of marking fluid, such as ink. Likewise, the print media feed printhead array 50 is defined by a single replaceable printhead 54 for printing multiple colors of marking fluid, such as ink. The multiple colors of ink in the single printheads 52*a*, 52*b* and 54 are all identical to one another. These multiple colors of ink are black, cyan, magenta and yellow. As an alternative, the single printheads 52*a*, 52*b* and 54 could each include only a single color of ink. That single color of ink could be black. As a further alternative as illustrated in FIG. 2, each of the first and second scan printhead arrays 48*a*, 48*b* could be defined by a first replaceable printhead 56*a*, 56*b*, and a second replaceable printhead 58*a*, 58*b*. Likewise, the print media feed printhead array 50 could be defined by a first replaceable printhead 60 and a second replaceable printhead 62. The first printheads 56*a*, 56*b*, 60 would print a single color of ink, such as black, while the second printheads 58*a*, 58*b*, 62 would print multiple colors of ink, such as cyan, magenta and yellow. As another alternative as illustrated in FIG. 3, each of the first and second scan printhead arrays 48*a*, 48*b* could be defined by a first replaceable printhead 64*a*, 64*b*, a second replaceable printhead 66*a*, 66*b*, a third replaceable printhead 68*a*, 68*b*, and a fourth replaceable printhead 70*a*, 70*b*. Likewise, the print media feed printhead array 50 could be defined by a first replaceable printhead 72, a second replaceable printhead 74, a third replaceable printhead 76 and a fourth replaceable printhead 78. The first printheads 64*a*, 64*b*, 72 would print a single color of ink, such as black, the second printheads 66*a*, 66*b*, 74 would print a single color of ink, such as cyan, the third printheads 68*a*, 68*b*, 76 would print a single color of ink, such as magenta, and the fourth printheads 70*a*, 70*b*, 78 would print a single color of ink, such as yellow. Regardless of the number of printheads, in one embodiment like printheads would receive like colors of marking fluid from a common source. Alternatively, each printhead could have its own source of marking fluid.

Figure 4A:
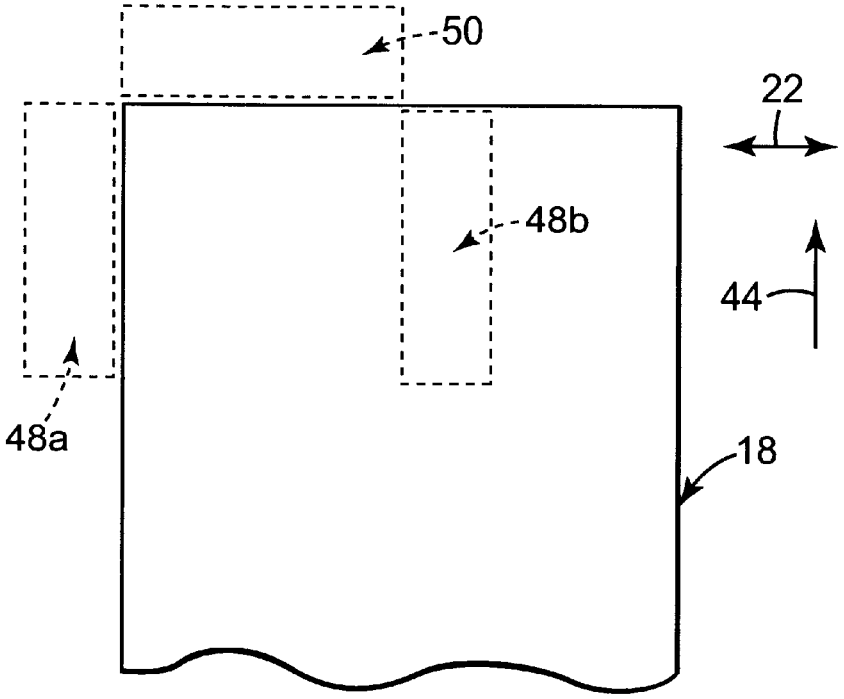
FIGS. 4A–4E illustrate the operation of the printing system of FIG. 1 to perform a print job in accordance with one embodiment of the present invention.

Operation, in accordance with one embodiment of the present invention, of the first and second marking engines 14, 16 of the printing system 10 shown in FIG. 1, is illustrated in FIGS. 4A–4E. In FIGS. 4A–4E, only the printhead arrays 48*a*, 48*b*, 50 and the print media 18 are illustrated for clarity. FIG. 4A (as well as FIG. 1) illustrates the print media 18 in the printing system 10 in position to be printed upon, in accordance with a print job (i.e., ready for the creation of text, characters and/or illustrations), by the first and second scan printhead arrays 48*a*, 48*b* and the print media feed printhead array 50.

Figure 4B:
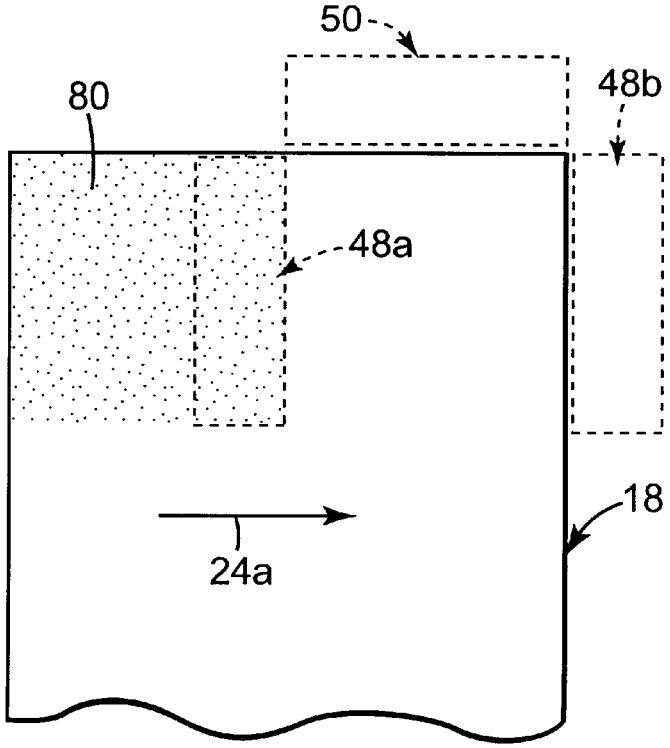

FIG. 4B illustrates a first step of a printing operation cycle. In this first step, the carriage 20 is moved by operation of the scan drive mechanism 26 in accordance with the printer control electronics 40 in the direction of the forward scan track 24*a*. In particular, the carriage 20 is moved only across a portion of the fall width dimension "W" of the print media 18 in the direction of the forward scan track 24*a*. During this movement of the carriage 20 in the direction of forward scan track 24*a*, only the first scan printhead array 48*a* deposits marking fluid onto the print media 18. This marking fluid is deposited along the width dimension "W" on a first portion of the print media 18. This deposition of marking fluid on this first portion of the print media 18 is represented by a light stippled square 80.

Figure 4C:
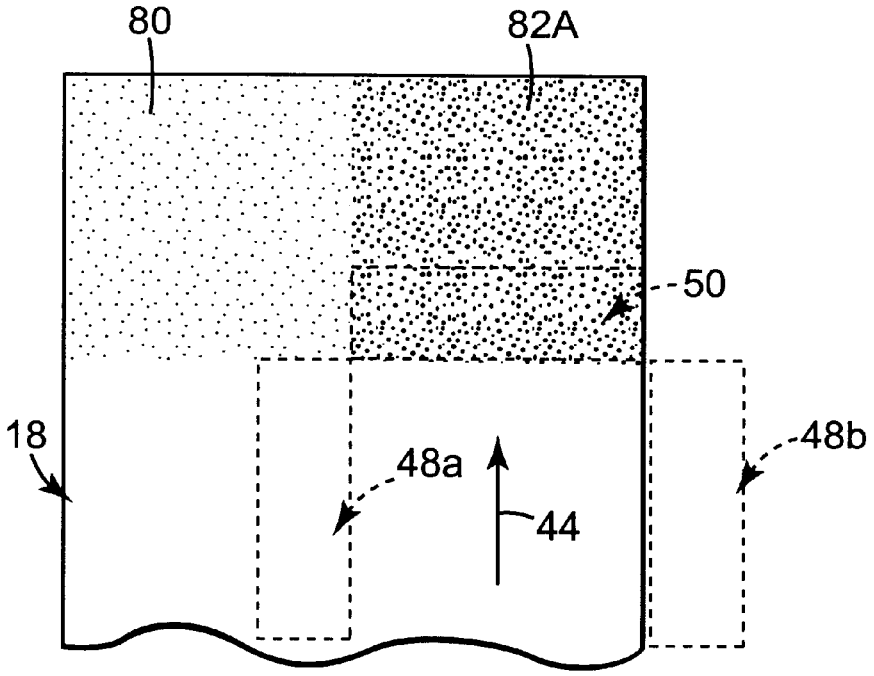

FIG. 4C illustrates a second step of the printing operation cycle. In this second step, the print media 18 is moved in the print media feed direction 44 by operation of the print media feed drive mechanism 42 in accordance with the printer control electronics 40. During this movement of the print media 18 in the print media feed direction 44, only the print media feed printhead array 50 deposits marking fluid onto the print media 18. This marking fluid is deposited in the length dimension "L" on a second portion of the print media 18 that is different than the first portion of the print media 18. This deposition of marking fluid on this second portion of the print media 18 is represented by a medium stippled square 82A.

Figure 4D:
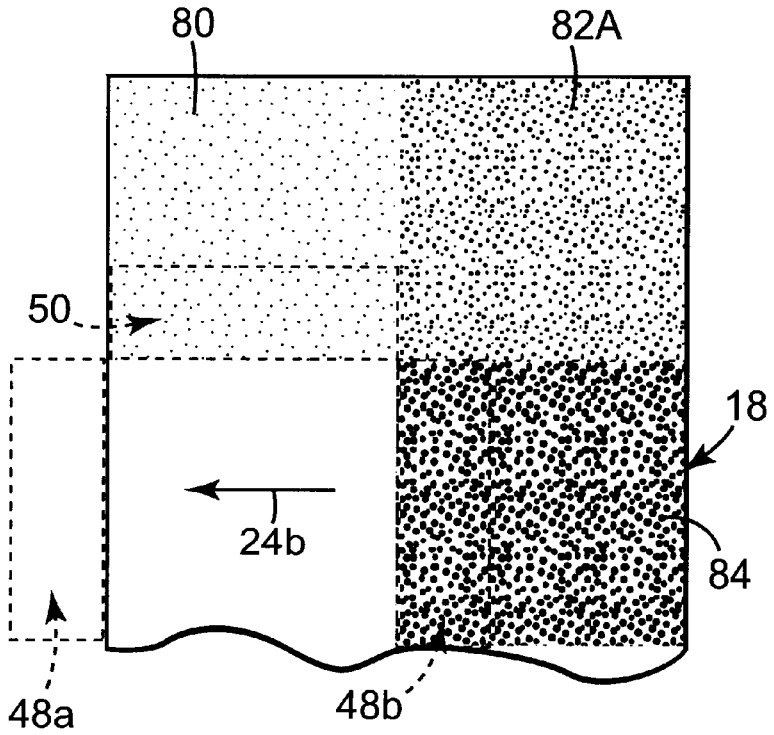

FIG. 4D illustrates a third step of the printing operation cycle. In this third step, the carriage 20 is moved by operation of the scan drive mechanism 26 in accordance with the printer control electronics 40 in the direction of the back scan track 24*b*. In particular, the carriage 20 is moved only across a portion of the full width dimension "W" of the print media 18 in the direction of the back scan track 24*b*. During this movement of the carriage 20 in the direction of back scan track 24*b*, only the second scan printhead array 48*b* deposits marking fluid onto the print media 18. This marking fluid is deposited along the width dimension "W" on a third portion of the print media 18 that is different than the first and second portions of the print media 18. This deposition of marking fluid on this third portion of the print media 18 is represented by a dark stippled square 84.

Figure 4E:
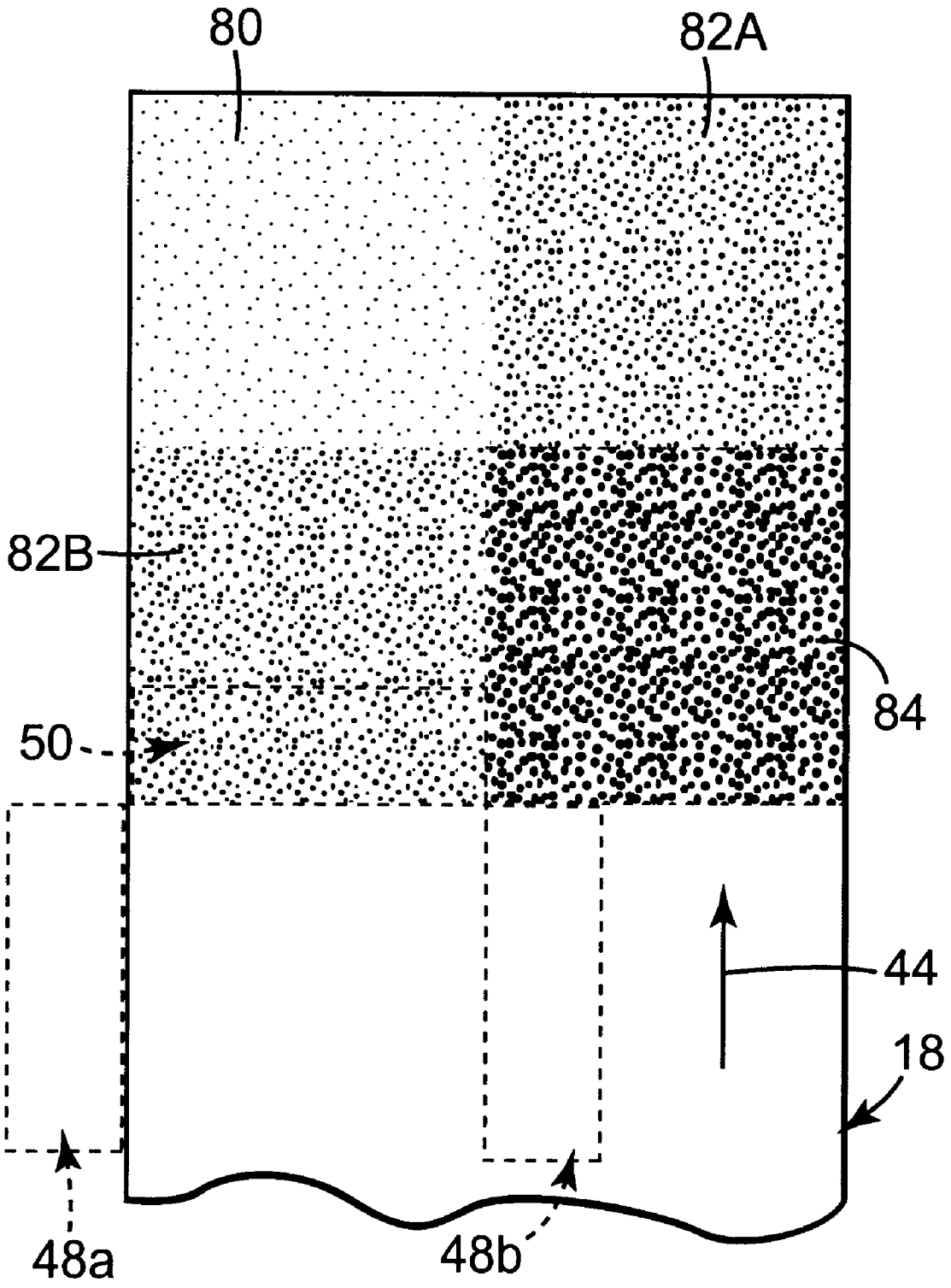

FIG. 4E illustrates a fourth and final step of the printing operation cycle. In this fourth step, the print media 18 is moved in the print media feed direction 44 by operation of the print media feed drive mechanism 42 in accordance with the printer control electronics 40. During this movement of the print media 18 in the print media feed direction 44, only the print media feed printhead array 50 deposits marking fluid onto the print media 18. This marking fluid is deposited in the length dimension "L" on a fourth portion of the print media 18 that is different than the first, second and third portions of the print media 18. This deposition of marking fluid on this fourth portion of the print media 18 is represented by a medium stippled square 82B. Squares 82A and 82B have the same medium stippled color since the marking fluid of both these squares is deposited by the print media feed printhead array 50. At this time, the carriage 20, and thereby the first and second scan printhead arrays 48*a*, 48*b* and the print media feed printhead array 50 are back in their original position as illustrated in FIGS. 1 and 4A. To complete printing of the full page of print media 18, this four step printing operation cycle described above and represented by FIGS. 4B–4E, is simply repeated until the entire page of the print job is accomplished. However, it is to be understood that the light, medium and dark stippled squares 80, 82A, 82B, 84 are not to be limiting and are used to simply depict what would otherwise be text and/or illustrations produced by the printhead arrays 48*a*, 48*b*, 50.

Using printhead arrays 48*a*, 48*b* that can print in the scan direction 22 and a printhead array 50 that can print in the print media feed direction 44 helps increase the print media throughput of the printing system 10 especially compared to conventional printing systems employing printhead arrays that only print in the scan direction. Moreover, since the printhead arrays 48*a*, 48*b* only need to be scanned across a portion of the full linear dimension of the print media 18, print media throughput of the printing system 10 can be further increased, especially compared to conventional printing systems employing printhead arrays that need to be scanned across the entire linear dimension of the print media.

Figure 5:
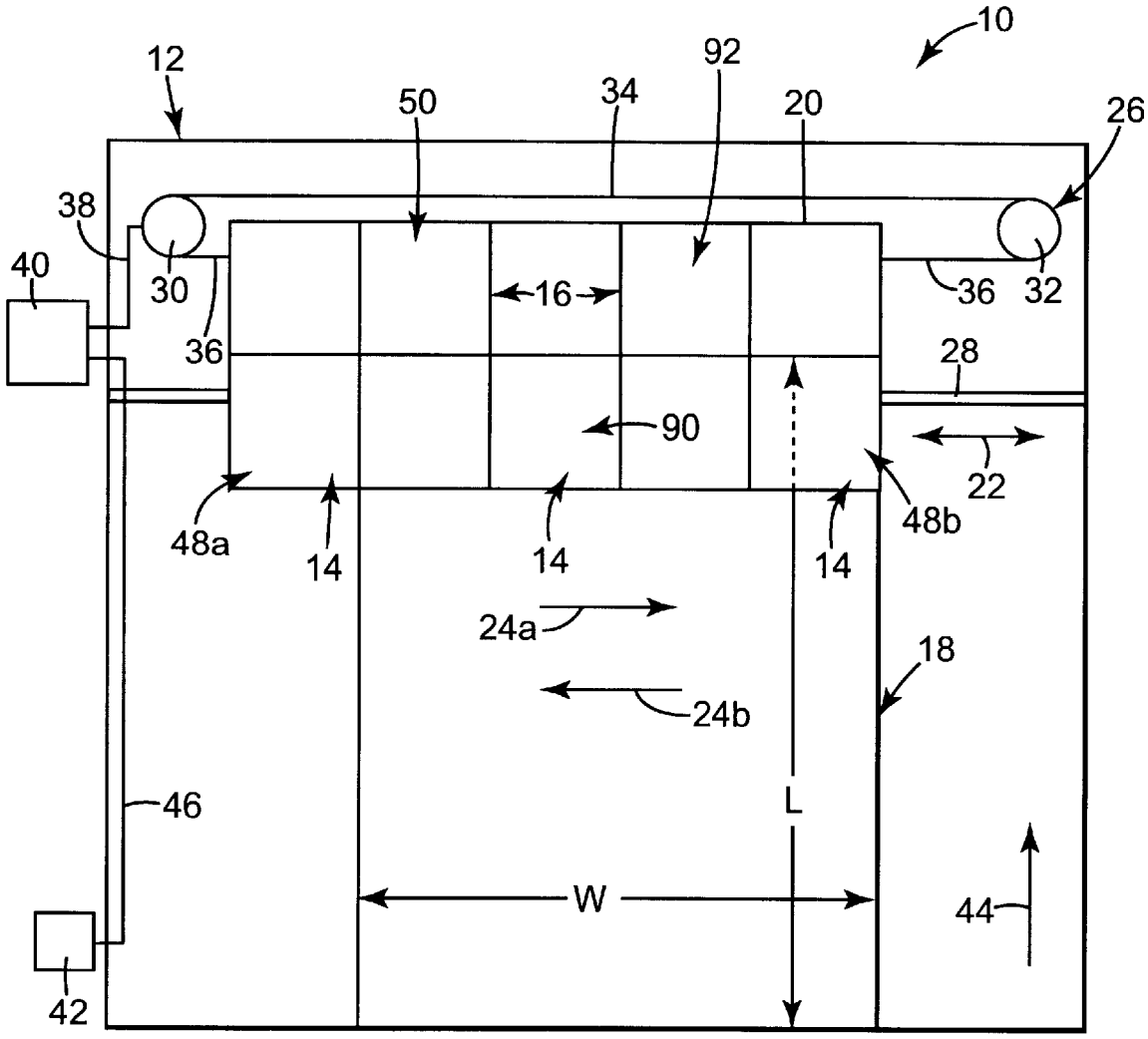
FIG. 5 is a schematic drawing of an alternative printing system having five printhead arrays printing in scan and print media feed directions in accordance with one further alternative embodiment of the present invention.

FIG. 5 illustrates an alternative printing system 10 that includes an additional or third scan printhead array 90 and a second or additional print media feed printhead array 92. All other parts are essentially the same as illustrated in FIG. 1 except for size of the printhead arrays 48*a*, 48*b*, 50 which would need to be adapted to accommodate printhead arrays 90, 92. However, the operation of the printhead arrays 48*a*, 48*b*, 50 is essentially the same as described in relation to FIG. 1, hence like parts are therefore labeled with like numerals. As seen in FIG. 5, the third scan printhead array 90 is spaced from and interposed between the first and second scan printhead arrays 48*a*, 48*b*, such that the print media feed printhead array 50 is interposed between but offset from the first and third scan printhead arrays 48*a*, 90. The third scan printhead array 90 is identical to the first and second scan printhead arrays 48*a*, 48*b* and only deposits marking fluid onto the print media 18 in the scan direction 22. However, as will be made clear below, the third scan printhead array 90 deposits marking fluid whenever the first scan printhead array 48*a* or the second scan printhead array 48*b* deposits marking fluid onto the print media 18. The additional print media feed printhead array 92 is spaced from the print media feed printhead array 50, with the additional print media feed printhead array 92 being interposed between but offset from the third and second scan printhead arrays 90, 48*b*. The additional print media feed printhead array 92 is identical to the print media feed printhead array 50 and only deposits marking fluid onto the print media in the print media feed direction 44. In other words, only when the print media 18 is advanced in the print media feed direction 44. However, as will be made clear below, the additional print media feed printhead array 92 deposits marking fluid whenever the print media feed printhead array 50 deposits marking fluid onto the print media 18.

Figure 6A:
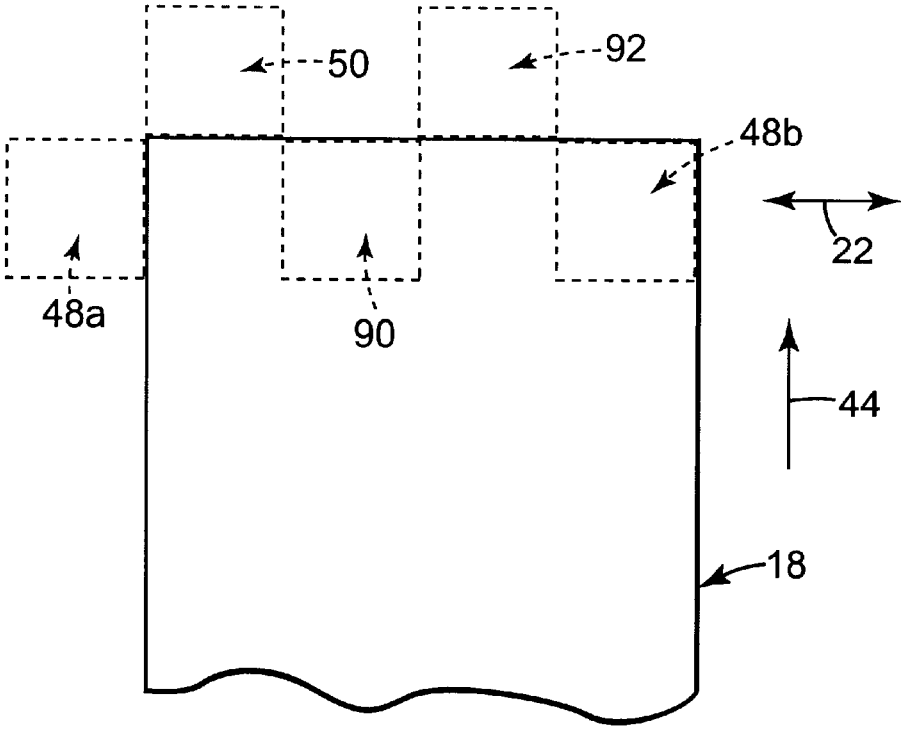
FIGS. 6A–6E illustrate the operation of the printing system of FIG. 5 to perform a print job in accordance with one further alternative embodiment of the present invention.

Operation, in accordance with one alternative embodiment of the present invention shown in FIG. 5, is illustrated in FIGS. 6A–6E. In FIGS. 6A–6E, only the printhead arrays 48, 48*b*, 90, 50, 92 and the print media 18 are illustrated for clarity. FIG. 6A (as well as FIG. 5) illustrates the print media 18 in the printing system 10 in position to be printed upon, in accordance with a print job (i.e., ready for the creation of text, characters and/or illustrations), by the first, second and third scan printhead arrays 48*a*, 48*b*, 90 and the print media feed printhead arrays 50, 92.

Figure 6B:
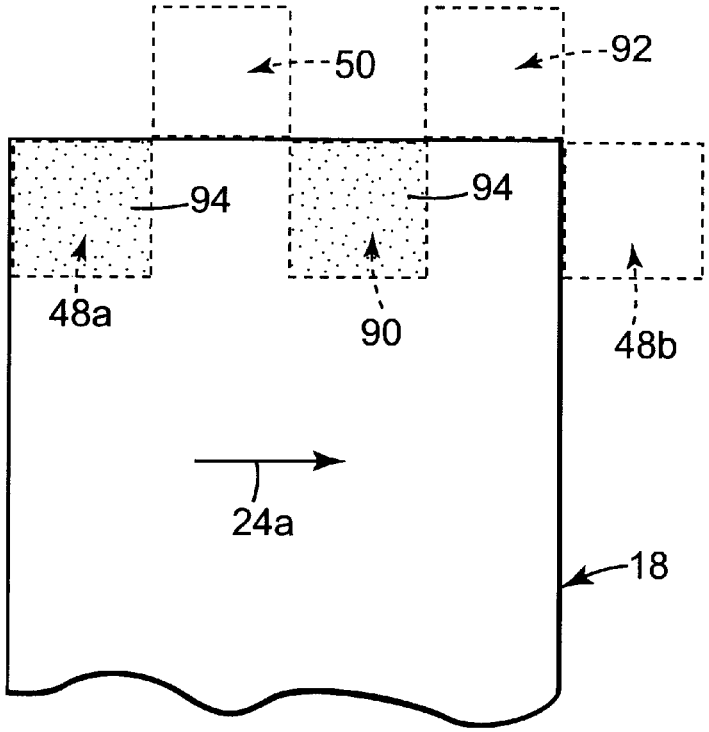

FIG. 6B illustrates a first step of a printing operation cycle. In this first step, the carriage 20 is moved by operation of the scan drive mechanism 26 in accordance with the printer control electronics 40 in the direction of the forward scan track 24*a*. In particular, the carriage 20 is moved only across a portion of the full width dimension "W" of the print media 18 in the direction of the forward scan track 24*a*. During this movement of the carriage 20 in the direction of forward scan track 24*a*, only the first and third scan printhead arrays 48*a*, 90 deposit marking fluid onto the print media 18. This marking fluid is deposited along the width dimension "W" on first portions of the print media 18. This deposition of marking fluid on these first portions of the print media 18 is represented by light stippled squares 94.

Figure 6C:
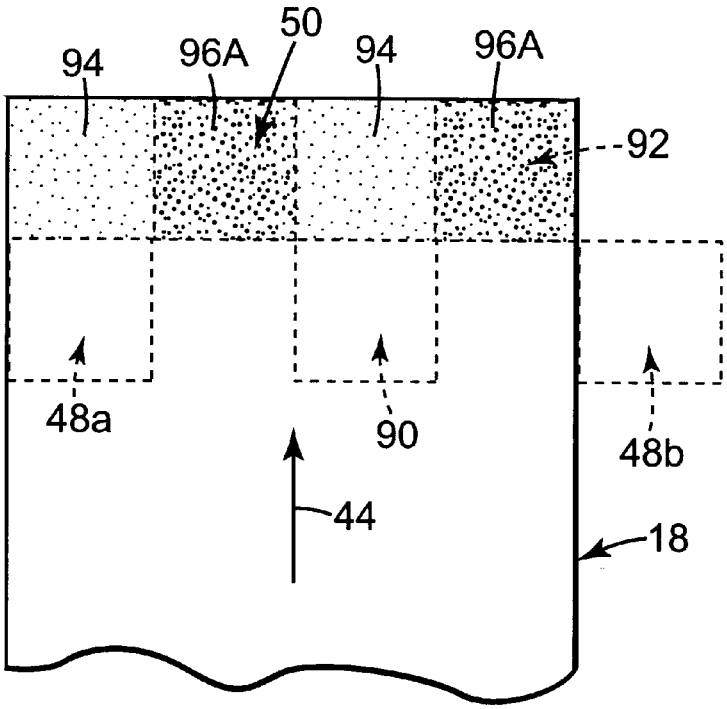

FIG. 6C illustrates a second step of the printing operation cycle. In this second step, the print media 18 is moved in the print media feed direction 44 by operation of the print media feed drive mechanism 42 in accordance with the printer control electronics 40. During this movement of the print media 18 in the print media feed direction 44, only the print media feed printhead arrays 50, 92 deposit marking fluid onto the print media 18. This marking fluid is deposited in the length dimension "L" on second portions of the print media 18 that are different than the first portions of the print media 18. This deposition of marking fluid on these second portions of the print media 18 is represented by medium stippled squares 96A.

Figure 6D:
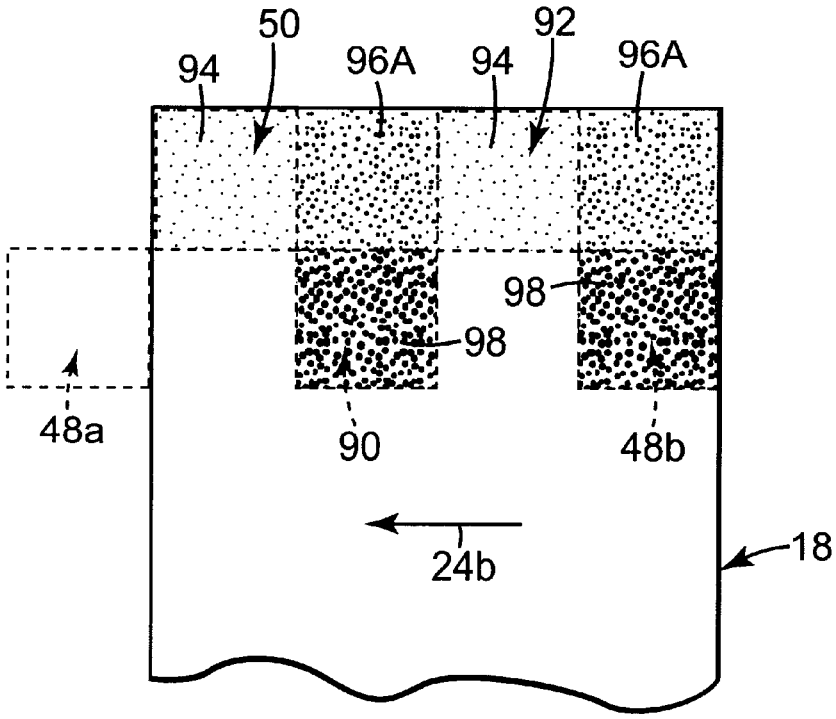

FIG. 6D illustrates a third step of the printing operation cycle. In this third step, the carriage 20 is moved by operation of the scan drive mechanism 26 in accordance with the printer control electronics 40 in the direction of the back scan track 24*b*. In particular, the carriage 20 is moved only across a portion of the full width dimension "W" of the print media 18 in the direction of the back scan track 24*b*. During this movement of the carriage 20 in the direction of back scan track 24*b*, only the second and third scan printhead arrays 48*b*, 90 deposit marking fluid onto the print media 18. This marking fluid is deposited along the width dimension "W" on third portions of the print media 18 that are different than the first and second portions of the print media 18. This deposition of marking fluid on these third portions of the print media 18 is represented by dark stippled squares 98.

Figure 6E:
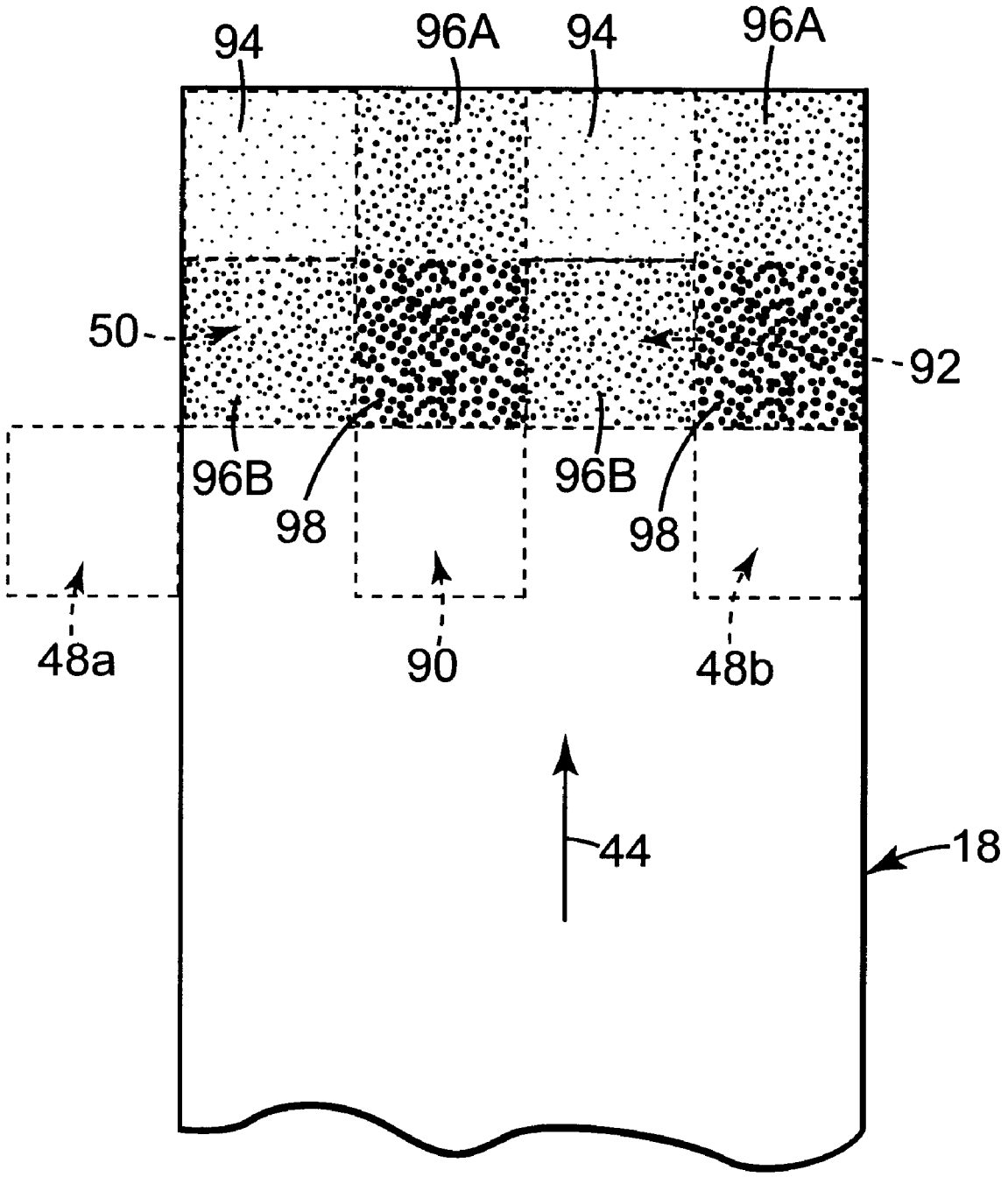

FIG. 6E illustrates a fourth and final step of the printing operation cycle. In this fourth step, the print media 18 is moved in the print media feed direction 44 by operation of the print media feed drive mechanism 42 in accordance with the printer control electronics 40. During this movement of the print media 18 in the print media feed direction 44, only the print media feed printhead arrays 50, 92 deposit marking fluid onto the print media 18. This marking fluid is deposited in the length dimension "L" on fourth portions of the print media 18 that are different than the first, second and third portions of the print media 18. This deposition of marking fluid on these fourth portions of the print media 18 is represented by medium stippled squares 96B. Squares 96A and 96B have the same medium stippled color since the marking fluid of both these squares is deposited by the print media feed printhead arrays 50, 92. At this time, the carriage 20, and thereby the first, second and third scan printhead arrays 48*a*, 48*b*, 90 and the print media feed printhead arrays 50, 92 are back in their original position as illustrated in FIGS. 5 and 6A. To complete printing of the full page of print media 18, this four step printing operation cycle described above and represented by FIGS. 6B–6E, is simply repeated until the entire page of the print job is accomplished. However, it is to be understood that the light, medium and dark stippled squares 94, 96A, 96B, 98 are not to be limiting and are used to simply depict what would otherwise be text and/or illustrations produced by the printhead arrays 48*a*, 48*b*, 90, 50, 92.

Using printhead arrays 48*a*, 48*b*, 90 that can print in the scan direction 22 and printhead arrays 50, 92 that can print in the print media feed direction 44 helps increase the print media throughput of the printing system 10 especially compared to conventional printing systems employing printhead arrays that only print in the scan direction. Moreover, since the printhead arrays 48*a*, 48*b*, 90 only need to be scanned across a portion of the full linear dimension of the print media 18, print media throughput of the printing system 10 can be further increased, especially compared to conventional printing systems employing printhead arrays that need to be scanned across the entire linear dimension of the print media.

Although, in the above described printing operation cycles, printing in the scan direction 22 and the print media feed direction 44 takes place along the width dimension "W" and the length dimension "L", respectively, of the print media 18, it is to be understood that the above described printing operation cycles can be adapted such that, printing in the scan direction 22 and the print media feed direction 44 takes place along the length dimension "L" and the width dimension "W", respectively, of the print media 18.

The printing system 10 makes use of multiple conventional, non PWA printhead arrays 48*a*, 48*b*, 50, (90, 92).

Although the present invention has been described with reference to preferred embodiments, workers skilled in the art will recognize that changes may be made in form and detail without departing from the spirit and scope of the invention.

What is claimed is:

1. A printing system for depositing marking fluid onto print media, the printing system comprising:

a first marking engine for depositing a first marking fluid onto print media in a scan direction; and a second marking engine for depositing a second marking fluid onto the print media in a print media feed direction.

2. The printing system of claim 1 wherein the first marking engine deposits the first making fluid onto the print media in only the scan direction.

3. The printing system of claim 1 wherein the second marking engine deposits the first making fluid onto the print media in only the print media feed direction.

4. The printing system of claim 3 wherein the first marking engine deposits the first making fluid onto the print media in only the scan direction.

5. The printing system of claim 1 wherein the scan direction is parallel to a width of the print media, and the print media feed direction is parallel to a length of the print media.

6. The printing system of claim 1 wherein the printing system is a thermal inkjet printing system.

7. A printing system for depositing marking fluid onto print media, the printing system comprising:

a first marking engine for depositing a first marking fluid onto print media in a scan direction;

a second marking engine for depositing a second marking fluid onto the print media in a print media feed direction;

a scan mechanism coupled to at least the first marking engine for moving the first marking engine back and forth across the print media in the scan direction; and a print media feed mechanism for moving the print media in the print media feed direction relative to at least the second marking engine.

8. The printing system of claim 7 wherein the scan mechanism is coupled to both the first and second marking engines for moving the first and second marking engines back and forth across the print media in the scan direction.

9. The printing system of claim 8 wherein the print media feed mechanism moves the print media in the print media feed direction relative to both the first and second marking engines.

10. A printing system for depositing marking fluid onto print media, the printing system comprising:

a first fluid ejection array for depositing a marking fluid onto print media in only a scan direction;

a second fluid ejection array spaced from the first fluid ejection array for depositing a marking fluid onto the print media in only the scan direction; and a third fluid ejection array, interposed between the first and second fluid ejection arrays, for depositing a marking fluid onto the print media in only a print media feed direction.

11. The printing system of claim 10 wherein only one of the first and second fluid ejection arrays deposits the marking fluid onto the print media at a time.

12. The printing system of claim 11 wherein the first fluid ejection array deposits the marking fluid only on a first portion of the print media, and wherein the second fluid ejection array deposits the marking fluid only on a second portion of the print media that is different than the first portion.

13. The printing system of claim 12 wherein the third fluid ejection array deposits the marking fluid only on a third portion of the print media that is different than the first and second portions.

14. The printing system of claim 10, and further including:

fourth fluid ejection array for depositing the marking fluid onto the print media in only the scan direction, wherein the fourth fluid ejection array is spaced from and interposed between the second and third fluid ejection arrays, and wherein the fourth fluid ejection array deposits the marking fluid on the print media only when either one of the first and second fluid ejection arrays are depositing the marking fluid on the print media; and a fifth fluid ejection array interposed between the second and fourth fluid ejection arrays for depositing the marking fluid onto the print media in only the print media feed direction and only when the third fluid ejection array is depositing marking fluid on the print media.

15. A printing system for depositing marking fluid onto print media, the printing system comprising:

a first fluid ejection array for depositing a first marking fluid onto the print media only during a first scan track that is forward across at least a section of the print media;

a second fluid ejection array spaced from the first fluid ejection array for depositing a second marking fluid onto the print media in a print media feed direction.

16. The printing system of claim 15, and further including:

at least a third fluid ejection array for depositing a marking fluid onto the print media during a second scan track that is back across at least a section of the print media.

17. A printing system for depositing marking fluid onto print media, the printing system comprising:

a first fluid ejection array for depositing a marking fluid onto print media only during a first scan track that is forward across at least a section of the print media;

a second fluid ejection array spaced from the first fluid ejection array for depositing a marking fluid onto the print media only during a second scan track that is back across at least a section of the print media;

a third fluid ejection array, interposed between the first and second fluid ejection arrays, for depositing a marking fluid onto the print media in only a print media feed direction;

a scan mechanism coupled to at least the first and second fluid ejection arrays for moving the first and second fluid ejection arrays across the print media along the first and second scan tracks; and a print media feed mechanism for moving the print media in the print media feed direction relative to at least the third fluid ejection array.

18. A method for depositing marking fluid on print media, the method comprising:

moving a first printhead in a first scan direction and simultaneously depositing the marking fluid from the first printhead onto the print media; and moving the print media in a print media feed direction relative to a second printhead and simultaneously depositing the marking fluid from the second printhead onto the print media.

19. The method of claim 18 wherein moving the first printhead includes:

moving the first printhead in the first scan direction across only a portion of a linear dimension of the print media to deposit the marking fluid only on the portion of the linear dimension of the print media.

20. The method of claim 19 wherein moving the print media includes:

moving the print media in the print media feed direction relative to the second printhead to deposit the marking fluid from the second printhead only on a remaining portion of the linear dimension of the print media.

21. The method of claim 18, and further including:

moving a third printhead in a second scan direction that is opposite the first scan direction and simultaneously depositing the marking fluid from the third printhead onto the print media.

22. A method for depositing a marking fluid on a print media, the method comprising:

moving a first printhead in a first scan direction across a first portion of the print media and simultaneously depositing the marking fluid only on the portion of a linear dimension of the print media; and moving the print media in a print media feed direction relative to a second printhead and simultaneously depositing the marking fluid from the second printhead onto a second portion of the print media that is different than the firs portion.

23. The method of claim 22, and further including:

moving a third printhead in a second scan direction, that is opposite the first scan direction, across a third portion of the print media that is different than the first portion and simultaneously depositing the marking fluid only on a different portion of the linear dimension of the print media.

* * * * *

UNITED STATES PATENT AND TRADEMARK OFFICE

CERTIFICATE OF CORRECTION

PATENT NO. : 6,641,251 B1
DATED : November 4, 2003
INVENTOR(S) : Rodriquez

It is certified that error appears in the above-identified patent and that said Letters Patent is hereby corrected as shown below:

Column 9,
Lines 41, 44 and 47, delete “making”, and insert therefor -- marking --.

Signed and Sealed this

Twenty-sixth Day of April, 2005

JON W. DUDAS
*Director of the United States Patent and Trademark Office*